US008876097B1

(12) United States Patent
Rego

(10) Patent No.: US 8,876,097 B1
(45) Date of Patent: Nov. 4, 2014

(54) SHINGLE HOLDER AND ALIGNMENT TOOL

(76) Inventor: Jeffrey S. Rego, Dartmouth, MA (US)

( * ) Notice: Subject to any disclaimer, the term of this patent is extended or adjusted under 35 U.S.C. 154(b) by 520 days.

(21) Appl. No.: 13/306,639

(22) Filed: Nov. 29, 2011

(51) Int. Cl.
*B25B 5/14* (2006.01)

(52) U.S. Cl.
USPC ..... 269/43; 269/3; 269/6

(58) Field of Classification Search
CPC ..... B25B 1/2478; B25B 1/103; B25B 1/2405
USPC ..... 269/43, 45, 6, 143, 249; 29/257, 276; 248/237; 33/42, 809, 464; 52/489.1, 52/404, 127
See application file for complete search history.

(56) References Cited

U.S. PATENT DOCUMENTS 2,949,947 A * 8/1960 Story ..... 269/147
5,165,642 A 11/1992 Rihaly
5,507,101 A * 4/1996 Mason ..... 33/608
5,526,577 A 6/1996 Nix
6,484,986 B1 11/2002 Kolodzieski
6,554,264 B1 * 4/2003 Alford ..... 269/147
7,114,715 B1 * 10/2006 Kirk ..... 269/147
7,124,551 B1 10/2006 Patera
8,001,668 B2 * 8/2011 Coffman et al. ..... 29/283
8,438,748 B1 * 5/2013 Moon ..... 33/783
2003/0075851 A1 * 4/2003 Alford ..... 269/147

* cited by examiner

*Primary Examiner* — Lee D Wilson
(74) *Attorney, Agent, or Firm* — Crossley Patent Law; Micah C. Gunn

(57) ABSTRACT

A shingle holder and alignment tool including a telescopic bar keeper, a telescopic rod guide and adjustable catches, the telescopic rod guide extendable along a horizontal axis to conform to a desired length of a row of shingles, the adjustable catches raising or lowering the rod guide relative a preceding row of shingles by way of a pair of slide guards, such that the shingle holder and alignment tool is operable by a single individual, configurable to shingles of various sizes and accurately aligns a new row of shingles to be installed upon a preceding row.

5 Claims, 4 Drawing Sheets

SHINGLE HOLDER AND ALIGNMENT TOOL

BACKGROUND OF THE INVENTION

Various types of shingle holder and alignment tools are known in the prior art. However, what is needed is a shingle holder and alignment tool that includes a telescopic bar keeper and a telescoping rod guide fittable to a desired length of a row of shingles to align and install shingles on the roof or exterior wall of a home or building.

FIELD OF THE INVENTION

The present invention relates to a shingle holder and alignment tool, and more particularly, to a shingle holder and alignment tool having a telescopic bar keeper and a telescoping rod guide fittable to a desired length of a row of shingles to align and install shingles on the roof or exterior wall of a home or building.

SUMMARY OF THE INVENTION

The general purpose of the shingle holder and alignment tool, described subsequently in greater detail, is to provide a shingle holder and alignment tool which has many novel features that result in a shingle holder and alignment tool which is not anticipated, rendered obvious, suggested, or even implied by prior art, either alone or in combination thereof.

Installing shingles on roofs and sidewalls can be a cumbersome and exacting task. It is necessary to ensure correct alignment of the shingles whereby the proportions of each row of shingles exactly overlaps the preceding row in a repeating pattern specific to the dimensions of the shingles at hand. Inattention to detail, or an incorrect alignment of shingles may result in a leak or increased erosion to the shingles resulting in a lessened lifespan and an urgent need for replacement, which can be costly an inconvenient. Furthermore, failure to accurately align shingles may make completion of a roofing or sidewall job impossible, the ultimate row of shingles unable to align with preceding rows, or unable to fit exactly to the remaining space, requiring reinstallation of the preceding rows—a costly and time consuming mistake.

The present invention, therefore, has been devised to assist in the accurate alignment and installation of shingles, increasing the efficiency and ability of a person using the device. The present device can be operated by one person, thus reducing required manpower and labor when entertaining a specific job requiring the installation of shingles.

The present shingle holder and alignment tool is easily operable, having a bar keeper and a rod guide spanning a desired length of a row of shingles. The bar keeper is pivotally attached to a pair of brackets, which brackets attach to a preceding row of shingles by means of a pair of catches. These catches are adjustable to raise or lower the rod guide, as desired, by means of a pair of slide guards enabling the present shingle holder and adjustment guide to be configured to align shingles of various sizes. New shingles to be installed are placed upon a bottom groove of the rod guide. The bar keeper is pivoted into a closed position, securing the shingles upon the rod guide. Shingles are then fastened into place, aligned correctly and appropriately for a timely completion to a shingle roofing or sidewall job.

The shingle holder and adjustment guide is extendable along a horizontal axis, the telescopic bar keeper and rod guide extending laterally to move the pair of brackets a desired distance apart, thus enabling the operator to add more shingles in a row without having to move the present device.

Thus has been broadly outlined the more important features of the present shingle holder and alignment tool so that the detailed description thereof that follows may be better understood and in order that the present contribution to the art may be better appreciated.

Objects of the present shingle holder and alignment tool, along with various novel features that characterize the invention are particularly pointed out in the claims forming a part of this disclosure. For better understanding of the shingle holder and alignment tool, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
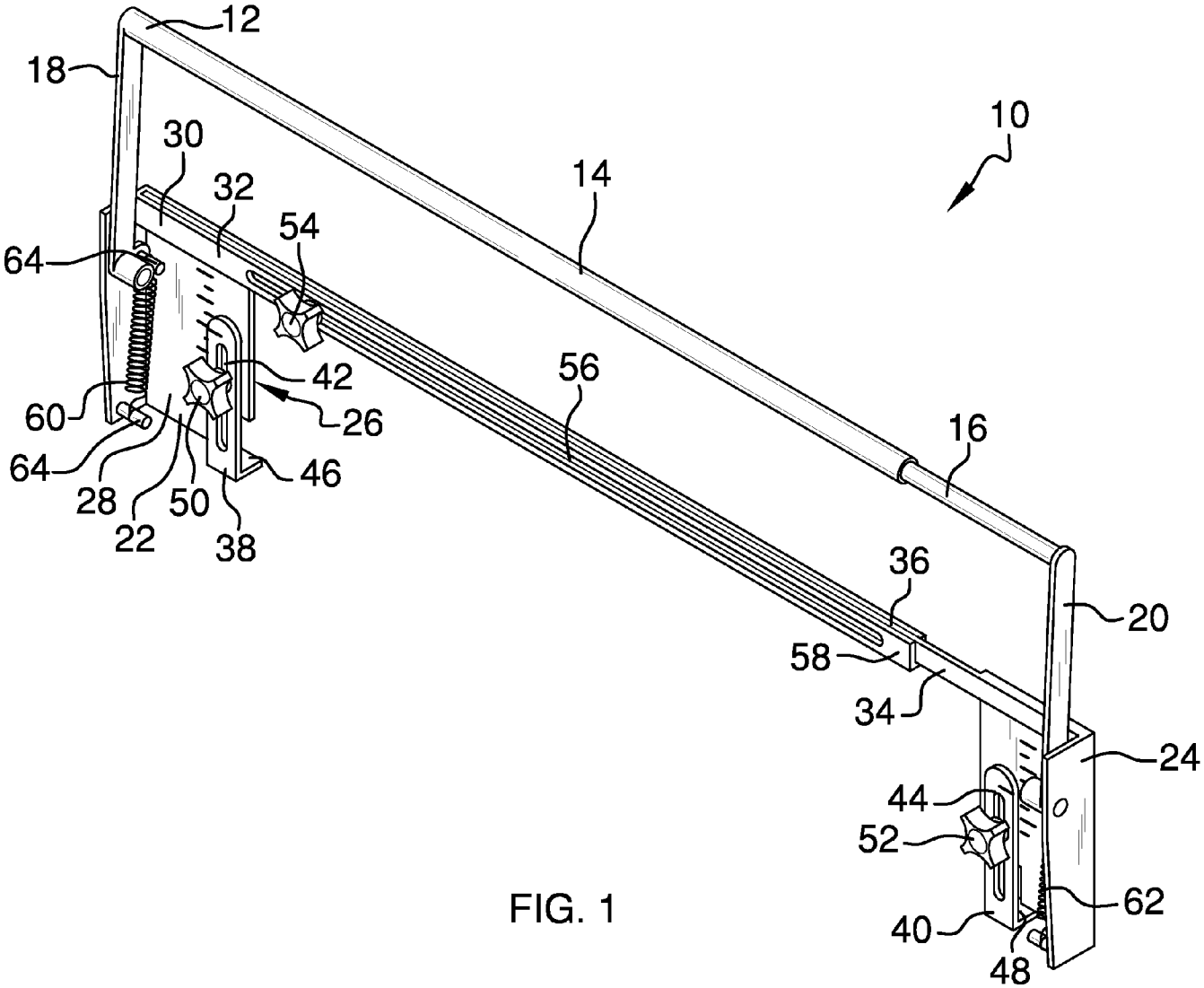
FIG. 1 is an isometric view.
Figure 2:
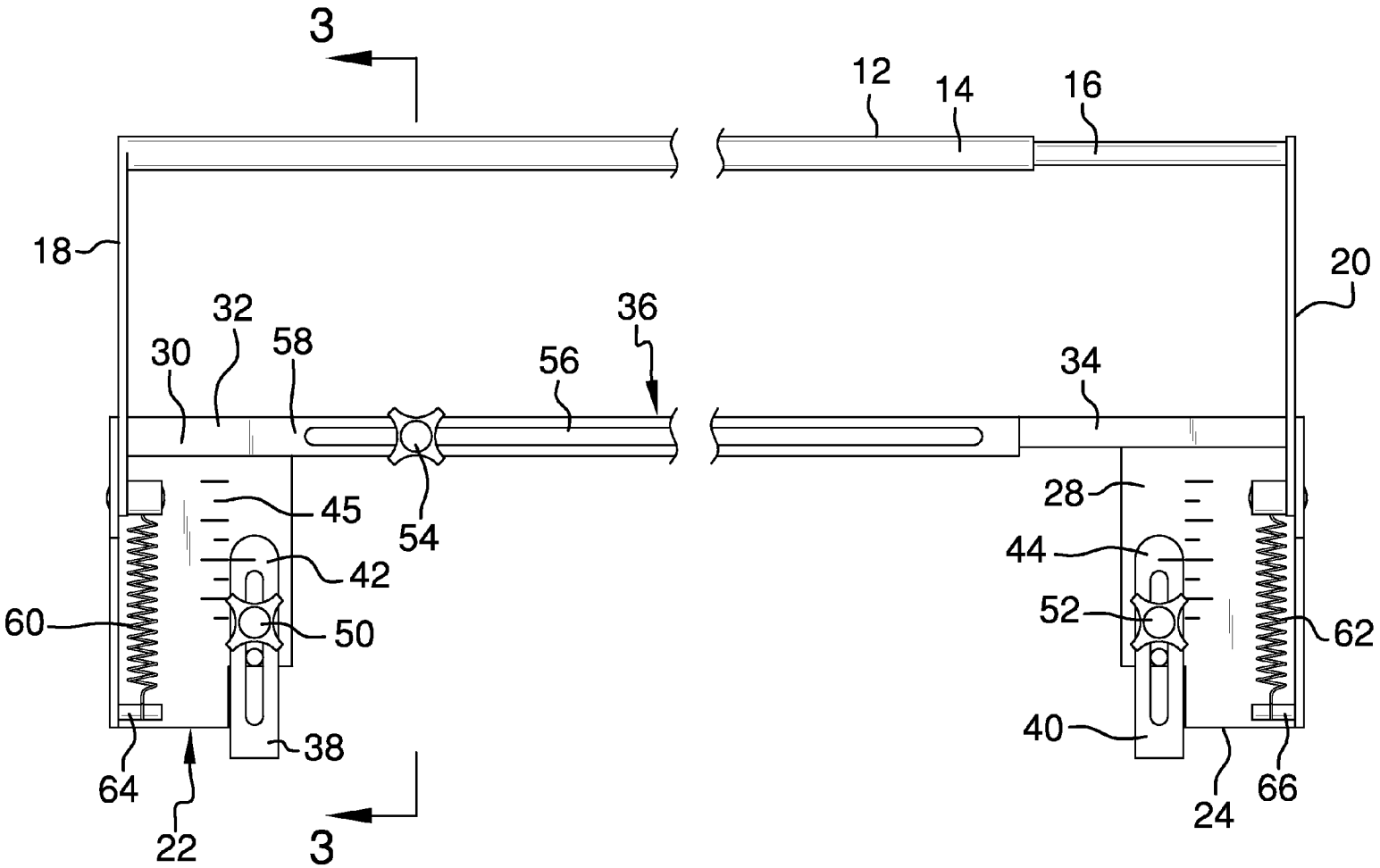
FIG. 2 is a top view.
Figure 3:
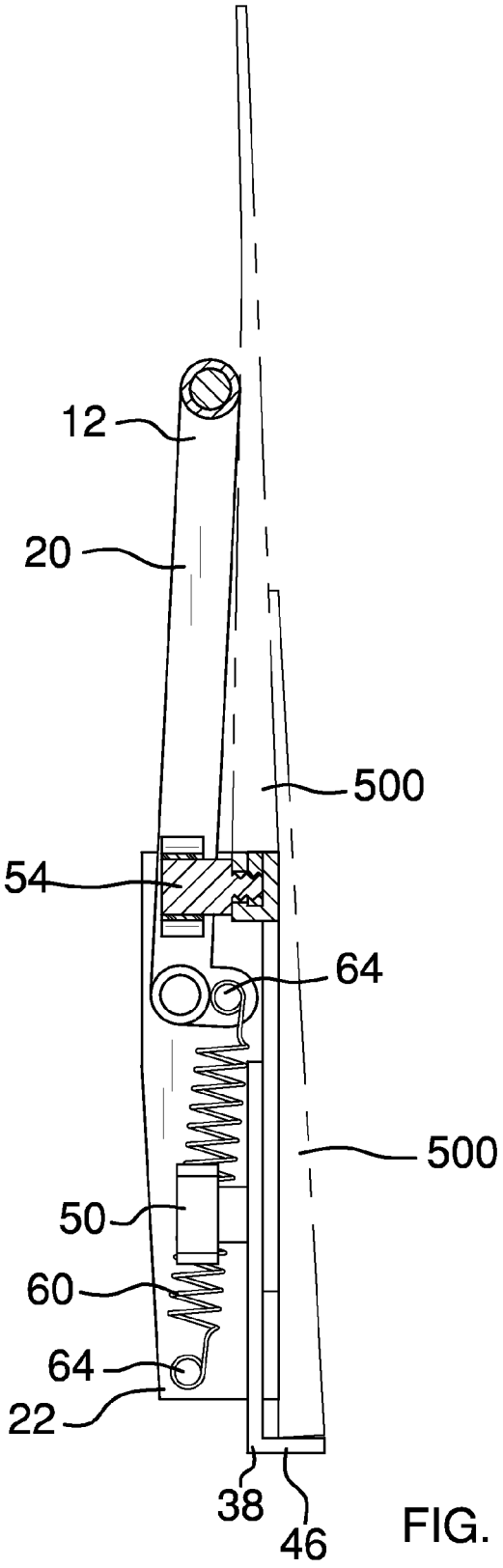
FIG. 3 is a cross section view taken along the line 3-3 of FIG. 2.
Figure 4:
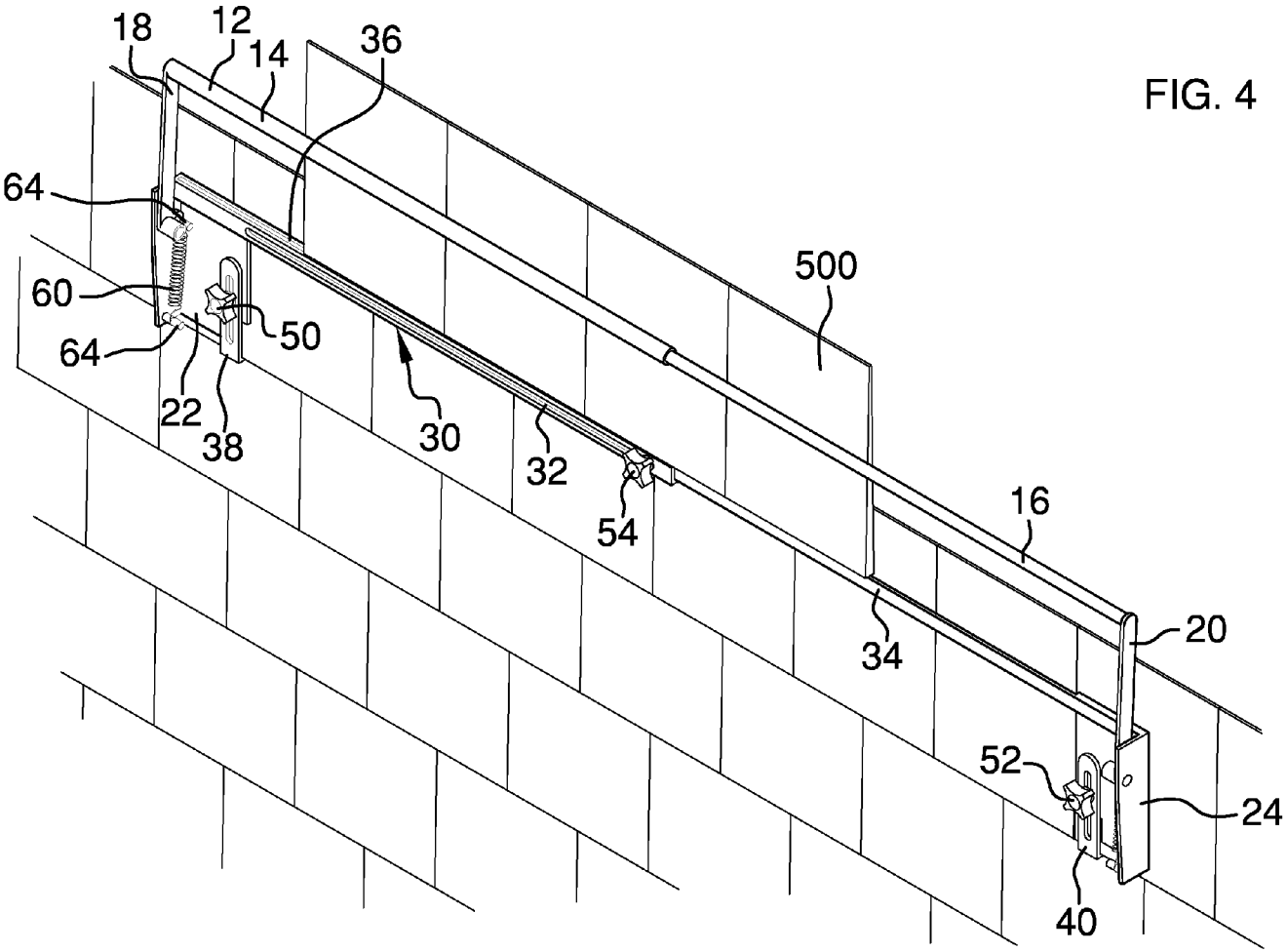
FIG. 4 is an in-use view.

With reference now to the drawings, and in particular FIGS. 1 through 4 thereof, example of the instant shingle holder and alignment tool employing the principles and concepts of the present shingle holder and alignment tool and generally designated by the reference number 10 will be described.

Referring to FIGS. 1 through 4 a preferred embodiment of the present shingle holder and alignment tool 10 is illustrated.

The shingle holder and alignment tool 10 includes a telescopic bar keeper 12 extendable along a horizontal axis, the bar keeper 12 having a first cylindrical member 14 a second cylindrical member 16 disposed within the first cylindrical member 14. The second cylindrical member 16 is extendable from within the first cylindrical member 14.

The bar keeper 12 has a first end 18, perpendicularly attached to the first cylindrical member 14 and a second end 20, perpendicularly attached to the second cylindrical member 16. The first end 18 and the second end 20 are pivotally attached to a first bracket 22 and a second bracket 24 respectively.

The first bracket 22 includes a contact face 26 and an upward face 28. The second bracket 24 is enantiomorphic with respect to the first bracket 22.

A parallelepiped telescopic rod guide 30 is disposed parallel to the bar keeper 12 between the first bracket 22 and the second bracket 24, the rod guide 30 having a first parallelepiped member 32 and a second parallelepiped member 34. The second parallelepiped member 34 slidingly extends from within the first parallelepiped member 32 along a horizontal axis and the first bracket 22 and the second bracket 24 are distanced farther apart as desired. The rod guide 30 has a bottom groove 36 configured to receive an edge of a shingle 500.

A first catch 38 and a second catch 40 are moveably attached to the first bracket 22 and the second bracket 24 respectively, the first 22 and second 24 catches adjustable along a respective first slide guide 42 and a second slide guide 44, the first 42 and second 44 slide guides extendable along a plane perpendicular to the rod guide 30, wherein each of the first catch 42 and the second catch 44 are extendable to accommodate a specific shingle height. A scale 45 aligns the first 42 and second 44 slide guard to a specific height in certain increments. The first 42 and second 44 catch have a first lip 46 and a second lip 48 respectively. The first 46 and second 48 lip are disposed downfacing from the contact face 26 and project perpendicularly from the respective first 42 and second 44 slide guard.

A first adjustment knob 50 is disposed upon the first bracket 22, the first adjustment knob 50 rotatably tightened to secure the first catch 38 at a desired extension by means of the first slide guide 42. A second adjustment knob 52 is disposed upon the second bracket 24, the second adjustment knob 52 rotatably tightened to secure the second catch 40 at a desired extension by means of the second slide guide 44. A third adjustment knob 54 is disposed upon the rod guide 30, the third adjustment knob 54 rotatably tightened to secure the rod guide 30 at a desired length of extension wherein the first bracket 22 and the second bracket 24 are fixed at a definite distance apart.

The rod guide 30 first parallelepiped member 32 has an elongated opening 56 along an outward surface 58, the third adjustment knob 54 rotationally engaging the second parallelepiped member 32 through the elongated opening 56 to secure the shingle holder and adjustment tool 10 at an extension with the first 22 and second 24 brackets at a desired distance apart.

The bar keeper 12 is secured in a closed position by means of a first spring 60 and a second spring 62. The first spring 60 is coiled between a pair of first spring mounts 64 disposed on the first end 18 and the first bracket 22. The second spring 62 is coiled between a pair of second spring mounts 66 disposed upon the second end 20 and the second bracket 24. The bar keeper 12 is pivoted against the first 60 and second springs 62 into an open position.

The shingle holder and adjustment tool 10 is thereby adapted to conform to a row of shingles, and aligns shingles to be installed over a previous row of shingles, holding the new shingles in position correctly overlapping the previous row or shingles.

What is claimed is:

1. A shingle holder and alignment tool comprising:

a telescopic bar keeper extendable along a horizontal axis, the bar keeper comprising:

a first cylindrical member;

a second cylindrical member disposed within the first cylindrical member, the second cylindrical member extendable from within the first cylindrical member;

a first end, perpendicularly attached to the first cylindrical member;

a second end, perpendicularly attached to the second cylindrical member;

wherein the first end and the second end pivotally attach to a first bracket and a second bracket respectively;

the first bracket comprising a contact face and an upward face and the second bracket enantiomorphic with respect to the first bracket;

a parallelepiped telescopic rod guide, disposed parallel to the bar keeper between the first bracket and the second bracket, the rod guide comprising:

a first parallelepiped member and a second parallelepiped member, the second parallelepiped member slidingly extendable from within the first parallelepiped member along a horizontal axis whereby the first bracket and the second bracket are distanced farther apart;

a first and a second catch moveably attached to the first bracket and the second bracket respectively, the first and second catches adjustable along a respective first slide guide and a second slide guide, the first and second slide guides extendable along a plane perpendicular the rod guide, wherein each of the first catch and the second catch are extendable to accommodate a specific shingle height;

a first adjustment knob disposed upon the first bracket, the first adjustment knob rotatably tightened to secure the first catch at a desired extension by means of the first slide guide;

a second adjustment knob disposed upon the second bracket, the second adjustment knob rotatably tightened to secure the second catch at a desired extension by means of the second slide guide;

a third adjustment knob disposed upon the rod guide, the third adjustment knob rotatably tightened to secure the rod guide at a desired length of extension wherein the first bracket and the second bracket are fixed at a definite distance apart.

2. The shingle holder and alignment tool of claim 1 wherein the bar keeper is secured in a closed position by means of a first spring and a second spring, the first spring coiled between a pair of spring mounts disposed on the first end the first bracket, the second spring coiled between a second pair of spring mounts disposed upon the second end and the second bracket.

3. The shingle holder and alignment tool of claim 2 wherein the bar keeper is pivoted against the first and second springs into an open position.

4. The shingle holder and alignment tool of claim 3 wherein the rod guide has a bottom groove, the bottom groove configured to receive an edge of a shingle.

5. The shingle holder and alignment tool of claim 4 wherein the rod guide first parallelepiped member has an elongated opening along an outward surface, the third adjustment knob rotationally engaging the second parallelepiped member through the elongated opening to secure the shingle holder and adjustment tool at an extension with the first and second brackets at a desired distance apart.

* * * * *